US010199722B2

(12) United States Patent
Stratis et al.

(10) Patent No.: US 10,199,722 B2
(45) Date of Patent: Feb. 5, 2019

(54) SYSTEMS AND TECHNIQUES FOR RADOME-ANTENNA CONFIGURATION

(71) Applicant: Raytheon Company, Waltham, MA (US)

(72) Inventors: Glafkos K. Stratis, Tucson, AZ (US); Wayne L. Sunne, Tucson, AZ (US); Jim R. Hicks, Tucson, AZ (US); Mark A. Owens, Tucson, AZ (US); Jerry D. Robichaux, Tucson, AZ (US); Douglas Mills, Tucson, AZ (US)

(73) Assignee: RAYTHEON COMPANY, Waltham, MA (US)

( * ) Notice: Subject to any disclaimer, the term of this patent is extended or adjusted under 35 U.S.C. 154(b) by 56 days.

(21) Appl. No.: 15/342,152

(22) Filed: Nov. 3, 2016

(65) Prior Publication Data

US 2018/0123229 A1 May 3, 2018

(51) Int. Cl.

| | |
|---|---|
| ***H01Q 1/42*** | (2006.01) |
| ***H01Q 3/24*** | (2006.01) |
| ***H01Q 1/52*** | (2006.01) |
| ***H01Q 1/28*** | (2006.01) |

(52) U.S. Cl.

CPC ..... *H01Q 1/42* (2013.01); *H01Q 1/281* (2013.01); *H01Q 1/521* (2013.01); *H01Q 3/24* (2013.01)

(58) Field of Classification Search

CPC ..... H01Q 1/42; H01Q 1/28; H01Q 1/281; H01Q 5/22

See application file for complete search history.

(56) References Cited

U.S. PATENT DOCUMENTS

| | | | | |
|---|---|---|---|---|
| 6,278,410 | B1 | 8/2001 | Soliman et al. | |
| 7,589,686 | B2 | 9/2009 | Balzovsky et al. | |
| 7,649,501 | B2 | 1/2010 | Wong et al. | |
| 8,890,765 | B1 * | 11/2014 | Dinh ..... | H01Q 3/446 343/872 |

* cited by examiner

*Primary Examiner* — Robert Karacsony
(74) *Attorney, Agent, or Firm* — Daly, Crowley, Mofford & Durkee, LLP

(57) ABSTRACT

A radome structure of an antenna system is provided having a plurality of switchable antenna elements disposed around a perimeter of the radome structure that can simultaneously track multiple targets and be implemented in a variety of different applications. Each of the switchable antenna elements can be individually switched between different radiation patterns to support different applications. The antenna system may include an infrared (IR) sensor pedestal, an IR sensor disposed on the IR pedestal and a plurality of switchable radio frequency (RF) antenna elements disposed in a circumferential direction around the IR sensor pedestal. In an embodiment, each of the plurality of switchable RF antenna elements can be switched from a first radiation pattern to a second radiation pattern to change an array radiation pattern of the antenna.

9 Claims, 7 Drawing Sheets

SYSTEMS AND TECHNIQUES FOR RADOME-ANTENNA CONFIGURATION

BACKGROUND

As is known in the art, in some missile radar systems, radio frequency (RF) antennas have been placed in front of and separate from a radome structure in which an optical (e.g., IR) sensor resides. The antennas are spaced from the radome structure in an attempt to avoid signal degradation issues. However, such designs limit the number of antennas that can be used in the respective radar system and such design approaches may result in aerodynamic issues for radar systems disposed on a missile.

For example, in some radar systems having a limited number of antennas, the radar system may only be able to track one target at a time or track multiple targets with a limited bandwidth. Further, such radar systems are typically designed and used for one specific type of application.

Some beamforming applications are designed to track multiple targets. However, such systems require much more complex electronics and space and therefore, are not appropriate for use in applications having a limited amount of space (e.g., seeker systems, missile systems, etc.). For example, a broadband, directional antenna may be needed for high speed applications. However, these antennas can take up valuable space in a center portion of an antenna system where an optical or RF seeker antenna is commonly located. Thus, such antennas are too large to allow to be included in a system with the optical and/or RF seeker portion of the system. Furthermore, many small, broadband, directional antennas are not conformal and thus not appropriate for inclusion on high speed airframes external to the radome.

Further, in some embodiments, whether internal or external to the radome, such broadband, directional antennas may interact with the optics. For example, when the antenna elements are placed external to the radome and proximate to or in front of optical sensors, such as on a missile seeker, the proximately located antenna structures may become heated (e.g., due to friction) and thus the RF antennas can become heat radiators. This results in interference with infrared (IR) sensors when the RF antennas are proximate the IR sensors.

SUMMARY

In accordance with the concepts, systems and techniques described herein, a missile radome structure of an antenna system is provided having a plurality of switchable antenna elements disposed around a perimeter of the radome structure that can simultaneously track multiple targets and be implemented in a variety of different applications. In an embodiment, each of the switchable antenna elements can be individually switched between different radiation patterns to support different applications, thus allowing the same radome structure to support each of the different applications without changing a general configuration of the radome structure.

In an embodiment, the switchable antenna elements are conformal to the radome structure and can be disposed around the perimeter of a mounting structure or a housing within the radome structure to receive signals incident on the antenna system from multiple directions to track multiple targets simultaneously. In some embodiments, the combination of multiple RF antenna elements may allow for the capability to have various diversity schemes, for example and without limitation, multiple-input and multiple-output (MIMO), reconfigurable arrays, and embodiments in which multiple RF antenna elements may simultaneously perform multi-role capabilities. For example, antenna elements of the same antenna system may be used to perform angle of arrival sensing, communication data links or other applications simultaneously.

In an embodiment, each of the switchable antenna elements can be switched between radiation patterns (e.g., forward radiation pattern, omnidirectional radiation pattern) to change an overall radiation pattern and/or polarization of the antenna system. For example, in one embodiment, a radiation pattern of one or more switchable antenna elements can be changed to communicate with other missiles for target information on the fly, etc. Thus, the antenna system having the switchable elements can be used for a variety of different types of applications, including but not limited to, tracking purposes, fusing, data link and other possible applications, without changing a general configuration of the antenna system.

Further, in some embodiments, the switchable elements can be positioned around the perimeter of the mounting structure or a housing in such a way to allow for more room to the optics area and reduce interference with the optics operation/activity. For example, the switchable elements can be positioned within the radome structure such that they are conformal to the airframe (e.g., conical airframe, cylindrical airframe) of the radome structure. In some embodiments, the switchable antenna elements can be recessed below a conical nose cone shape, this leaving a majority of that conical volume free for other hardware. Further, the switchable elements can be arranged in different orientations around the perimeter of the mounting structure or the housing.

In an embodiment, each of the switchable antenna elements can have a small size, be made conformal to a conical or cylindrical airframe of the radome structure thus leaving valuable center real estate available for an optics or RF seeker portion. The switchable antenna elements can have broad bandwidth, directional radiation patterns and gain and can be used as a single element or in an array of elements. In some embodiments, each of the switchable antenna elements can be scaled to cover different frequency bands.

In one aspect, an antenna is providing having an infrared (IR) sensor pedestal, an IR sensor disposed on the IR pedestal and a plurality of switchable radio frequency (RF) antenna elements disposed in a circumferential direction around the IR sensor pedestal. In an embodiment, each of the plurality of switchable RF antenna elements can be switched from a first radiation pattern to a second radiation pattern to change an array radiation pattern of the antenna.

In some embodiments, each of the plurality of switchable antenna elements may have a forward radiation pattern and an omnidirectional radiation pattern. A ground plane may be disposed in a circumferential direction around a bottom portion of the IR sensor pedestal. Each of the plurality of switchable RF antenna elements can be positioned at the bottom portion of the IR pedestal such that each of the plurality of switchable RF antenna elements are positioned between the IR sensor and the ground plane. In some embodiments, one or more of the plurality of switchable RF antenna elements can be disposed at a different level relative to the ground plane and along the circumferential direction around the IR sensor pedestal with respect to another switchable RF antenna element.

Each of the plurality of RF antenna elements can be symmetrically disposed around the IR sensor pedestal. In some embodiments, one or more of the plurality of switchable RF antenna elements can have a different orientation with respect to another switchable RF antenna element. In one embodiment, in a first orientation, the switchable RF antenna elements are parallel with the surface of the IR sensor pedestal and in a second orientation, the switchable RF antenna elements are perpendicular to the surface of the IR pedestal. The plurality of switchable RF antenna elements may include a Vivaldi antenna element.

In another aspect, a radome is provided having a housing, which defines a radome cavity, said housing, having a first surface and a second surface and a plurality of switchable radio frequency (RF) antenna elements disposed within the radome cavity. In an embodiment, each of the plurality of switchable RF antenna elements can be switched from a first radiation pattern to a second radiation pattern. In some embodiments, each of the plurality of switchable radio frequency RF antenna elements may have a forward radiation pattern and an omnidirectional radiation pattern.

In some embodiments, a ground plane may be disposed within a bottom portion of the radome cavity. Each of the plurality of switchable RF antenna elements may be disposed along a circumferential direction around the radome cavity such that each of the plurality of switchable RF antenna elements are positioned between a top portion of the radome cavity and the ground plane. In some embodiments, one or more of the plurality of switchable RF antenna elements can be disposed at a different level relative to the ground plane and along the circumferential direction around the IR sensor pedestal with respect to another switchable RF antenna element. In one embodiment, one or more of the plurality of switchable RF antenna elements can have a different orientation with respect to another switchable RF antenna element. In some embodiments, each of the plurality of antenna elements are recessed within an outer surface of the RF radome region.

In another aspect, an antenna is provided having a radio frequency (RF) radome region and a plurality of switchable radio frequency (RF) antenna elements disposed within the RF radome region. In an embodiment, each of the plurality of switchable RF antenna elements can be switched from a first radiation pattern to a second radiation pattern to change an array radiation pattern of the antenna.

In some embodiments, each of the plurality of switchable RF antenna elements can have a forward radiation pattern and an omnidirectional radiation pattern. One or more of the plurality of switchable RF antenna elements can have a different orientation with respect to another switchable RF antenna element. One or more of the plurality of switchable RF antenna elements can be disposed at a different level along a circumferential direction around the inner surface of the RF radome region with respect to another switchable RF antenna element.

BRIEF DESCRIPTION OF THE DRAWINGS

The foregoing features may be more fully understood from the following description of the drawings. The drawings aid in explaining and understanding the disclosed technology. Since it is often impractical or impossible to illustrate and describe every possible embodiment, the provided figures depict one or more exemplary embodiments. Accordingly, the figures are not intended to limit the scope of the invention. Like numbers in the figures denote like elements.

DETAILED DESCRIPTION

Figure 1A:
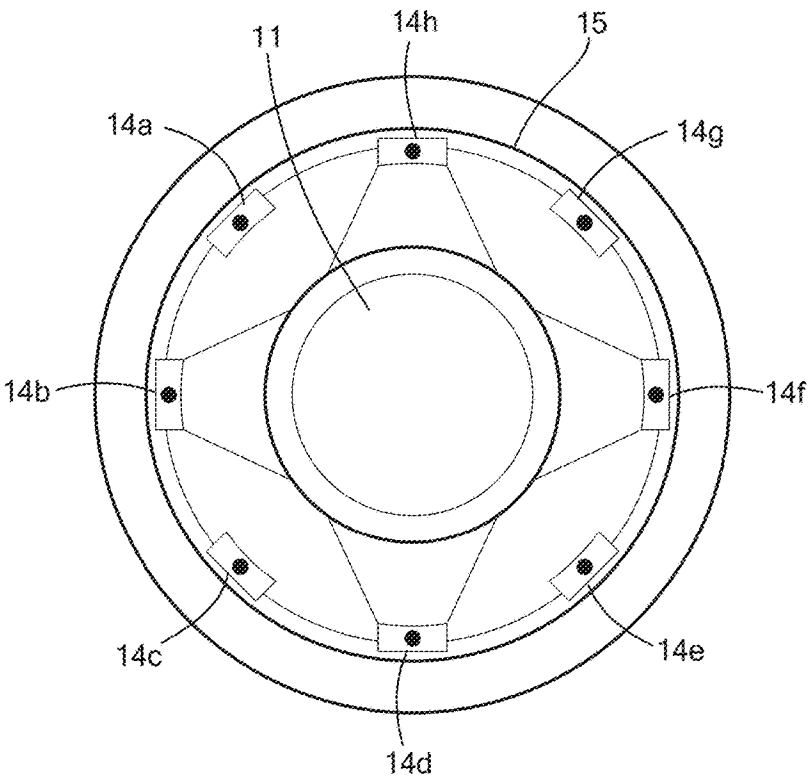
FIG. 1A is an isometric top view of the antenna system of FIG. 1.
Figure 1:
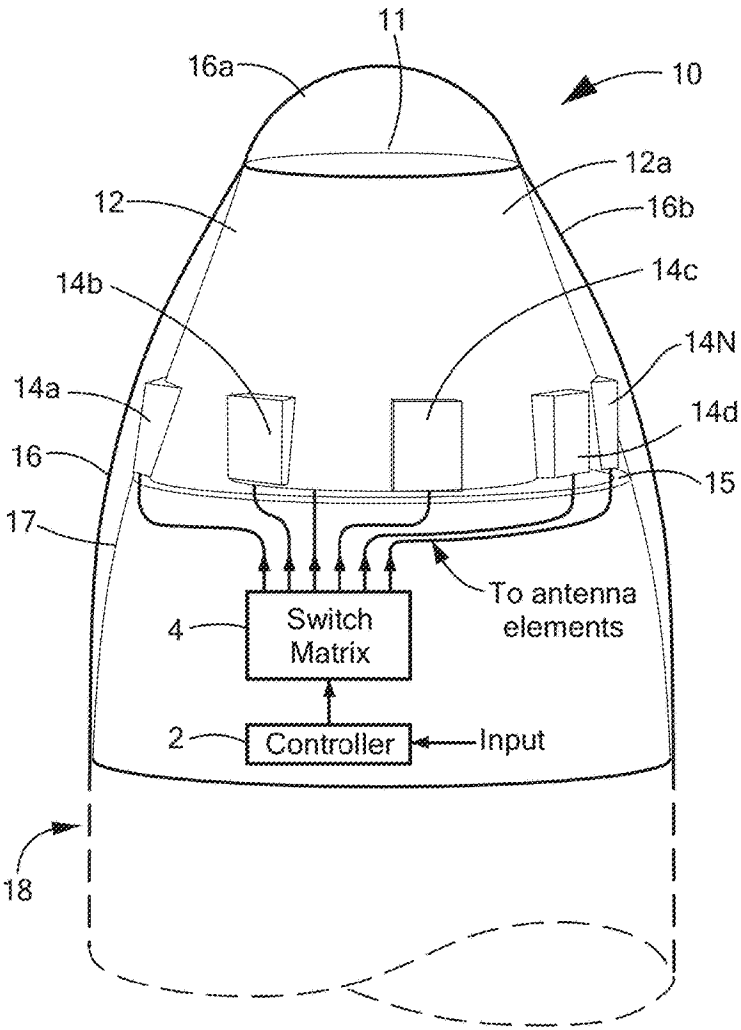
FIG. 1 is an isometric front view of one embodiment of an antenna system.
Figure 1C:
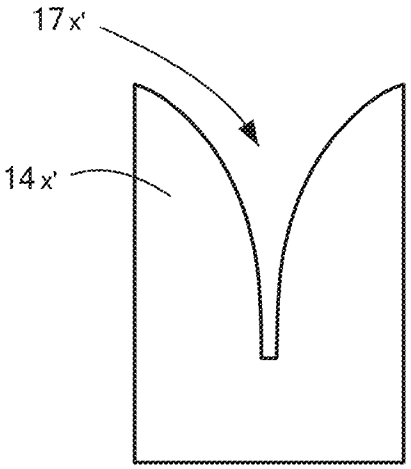
FIG. 1C is a front view of an embodiment of an antenna element.

Now referring to FIGS. 1-1C, in which like designations indicate like elements, a missile seeker 10 includes a sensor (e.g., infrared (IR) sensor) 11 disposed on a top surface of a pedestal 12. An RF antenna system is provided from a plurality of antenna elements 14*a*-14*n* disposed along an outer surface 12*a* of pedestal 12. Thus, missile seeker 10 may correspond to an infrared/radiofrequency (IR/RF) seeker.

The plurality of antenna elements 14*a*-14*n* can be symmetrically disposed in a circumferential direction around the outer surface 12*a*. In some embodiments, the plurality of antenna elements 14*a*-14*n* are disposed above a ground plane 15.

A radome 16 having an IR portion 16*a* and an RF portion 16*b* is disposed over and coupled to a seeker body or frame 17 using known techniques. Missile seeker 10 is coupled to a missile body 18 (here shown in phantom since it is not properly part of missile seeker 10). The missile seeker system 10 may generally refer to a seeker portion of a missile radar system herein. Sensor 11 may be any type of sensor including an IR optics sensor. In some embodiments, sensor 11 may be an RF sensor. The RF sensor may be enclosed in the sensor 11 and isolated from antenna elements 14*a*-14*n*.

In some embodiments, antenna elements 14*a*-14*n* may be disposed such that they are off-set relative to each other along outer surface 12*a*. The arrangement and positioning of a respective one of the plurality of antenna elements 14*a*-14*n* can be selected based upon a particular application and properties of missile seeker 10.

In some embodiments, the plurality of antenna elements 14*a*-14*n* may be disposed along outer surface 12*a* such that they are between sensor 11 and ground plane 15. For example, ground plane 15 may be disposed on, along or otherwise formed on a bottom portion of outer surface 12*a*. Ground plane 15 may be a metallic portion of pedestal 12. In some embodiments, ground plane 15 may include one or more holes or apertures (e.g., to allow optics to pass through) and one or more antenna elements 14*a*-14*n* may be disposed around the hole in ground plane 15. The antenna elements 14*a*-14*n* may be disposed above ground plane 15 to allow one or more of the antenna elements 14*a*-14*n* to act as monopole antennas. For example, a feed signal (e.g., applied voltage) may be provided between at least one of antenna elements 14*a*-14*n* and ground plane 15 to generate an omnidirectional radiation. It should be appreciated that in some embodiments, with antenna elements 14*a*-14*n* disposed above ground plane 15, a feed (e.g., applied voltage) may be provided between two of antenna elements 14*a*-14*n* to generate a forward radiation pattern, as will be described in greater detail below.

In an embodiment, missile seeker 10 may include a controller 2 and a switch matrix 4. Controller 2 and switch matrix 4 may be the same as or substantially similar to a computing device and include includes a processor, a volatile memory, and/or a non-volatile memory. The non-volatile memory may store computer instructions, an operating system and data. In an embodiment, the data may include instructions from a control center and/or another antenna system, received input signals, feed signals, arrangement of antenna elements 14*a*-14*n*, and configurations to generate forward and/or omnidirectional radiation patterns. Controller 2 and switch matrix 4 may be configured to generate and provide the feed signal to one or more of antenna elements 14*a*-14*n* and/or ground plane 15 to generate one or more radiation patterns. For example, antenna elements 14*a*-14*n* and thus missile seeker 10 can be configured to generate a forward radiation pattern and/or an omnidirectional radiation pattern responsive to a feed signal from controller 2 and switch matrix 4. In some embodiments, antenna elements 14*a*-14*n* and thus missile seeker 10 can be configured to generate a forward radiation pattern and an omnidirectional radiation pattern simultaneously.

Controller 2 may receive an input signal from a control center and/or another antenna system indicating one or more radiation patterns to be generated. Controller 2 can generate a feed signal corresponding to the one or more radiation patterns and provide the feed signal to switch matrix 4. In some embodiments, the feed signal may include a voltage value and may be used to instruct and/or switch one or more of antenna elements 14*a*-14*n* to generate the appropriate one or more radiation patterns. Switch matrix 4 may be coupled to each of antenna elements 14*a*-14*n* and ground plane 15 and be configured to provide the feed signal to each of antenna elements 14*a*-14*n* and ground plane 15.

In some embodiments, to generate a forward radiation pattern, switch matrix 4 may provide the feed signal (e.g., applied voltage) between two or more antenna elements 14*a*-14*n*. The feed signal may cause an excitation between the two antenna elements 14*a*-14*n* such that energy is moving forward and thus generate a forward radiation pattern (e.g., FIG. 2).

To generate an omnidirectional radiation pattern, switch matrix 4 may provide the feed signal to at least one of antenna elements 14*a*-14*n* and ground plane 15. The feed signal may cause an excitation between the respective one of antenna element 14*a*-14*n* and ground plane 15. Thus, the respective one of antenna elements 14*a*-14*n* can be configured to act substantially similar to a monopole antenna and generate an omnidirectional radiation pattern.

Switch matrix 4 can be configured to switch antenna elements 14*a*-14*n* between different radiation patterns using different feed signals and change an overall radiation pattern and/or polarization of the antenna system. The radiation pattern may be generated using one of antenna elements 14*a*-14*n*. The radiation pattern may be generated using a combination of two or more antenna elements 14*a*-14*n*. In some embodiments, multiple radiation patterns (e.g., omnidirectional, forward) simultaneously using different combinations of antenna elements 14*a*-14*n*.

The ability to generate and utilize different radiation patterns can allow for various configurations of antenna elements 14*a*-14*n* to perform two or more operations simultaneously. For example, in some embodiments, one or more antenna elements 14*a*-14*n* may be configured to generate a forward radiation pattern and be used for angle of arrival calculations while one or more different antenna elements 14*a*-14*n* may be configured to generate an omnidirectional radiation pattern and be used for data link communications.

In some embodiments, one or more antenna elements 14*a*-14*n* can be configured to generate an omnidirectional radiation pattern and can be used for angle of arrival calculations. For example, if an incoming signal arrives from a generally side portion of missile seeker 10 as opposed to a forward direction relative to a top portion of missile seeker 10.

One or more antenna elements 14*a*-14*n* can be configured to generate an omnidirectional radiation pattern and can be used for angle of arrival calculations and for data link communications. For example, multiple targets may be within a range of the antenna system and a determination may be made as to which target to track. A first target may be in a forward position relative to a top portion of missile seeker 10 and a second target may be positioned adjacent to a side portion of missile seeker 10. Thus, a determination may be made to prioritize the two targets. The antenna system may determine to track the second target and transmit a communication signal to a second antenna system to track the first, forward, target. The one or more antenna elements 14*a*-14*n* configured to generate the omnidirectional radiation pattern may be used to track the second target and may be used to establish the communications link with the second antenna system and/or control center.

Now referring to FIG. 1A, a top view of missile seeker 10 is shown having the plurality of antenna elements 14*a*-14*n* symmetrically disposed in a circumferential direction around the outer surface 12*a*. In an embodiment, antenna elements 14*a*-14*n* are disposed completely around outer surface 12*a* such that a signal (e.g., RF signal) incident on missile seeker 10 in any direction is received by at least one antenna element 14. Thus, missile seeker 10 has 360° coverage to detect and receive incoming signals as each region around missile seeker 10 is aligned with or includes at least one antenna element 14.

Figure 1B:
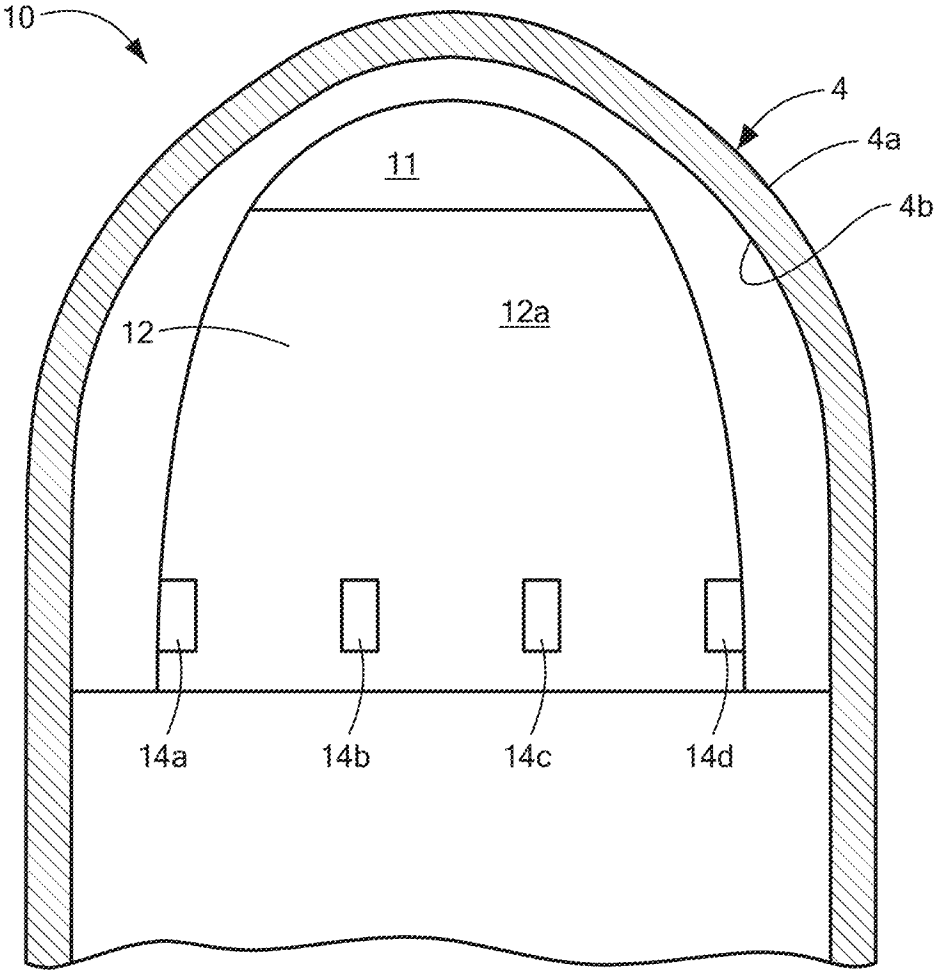
FIG. 1B is an isometric front view of one embodiment of a radio-frequency (RF) radome disposed about an antenna system.

In some embodiments, an RF radome may be disposed around missile seeker 10. For example, and now referring to FIG. 1B, missile seeker 10, which includes IR sensor 11 and IR pedestal 12, can be disposed within an RF radome 4 that is disposed about an outer surface of missile seeker 10.

The RF radome 4 has an inner surface 4*a*, an outer surface 4*b*, and a predetermined thickness established by the distance between inner surface 4*a* and outer surface 4*b*. In an embodiment, RF radome 4 may be a dielectric radome provided around the outer surface of missile seeker 10 to, among other things, protect the internal components and circuitry of missile seeker 10 from an exterior environment. In some embodiments, IR sensor 11 may include an IR optics radome region within RF radome 4.

The plurality of antenna elements 14*a*-14*n* can be symmetrically disposed in a circumferential direction around outer surface 12*a* of IR pedestal 12 within RF radome 4. However, it should be appreciated that the plurality of antenna elements 14*a*-14*d* may be disposed on a variety of different surfaces within a cavity defined by RF radome 4. For example, the plurality of antenna elements 14*a*-14*d* may be disposed along inner surface 4*a* of RF radome 4. In other embodiments, the plurality of antenna elements 14*a*-14*d* may be positioned at a bottom portion of the RF radome 4 with respect to a peak of the missile seeker 10.

The plurality of antenna elements 14*a*-14*d* may be symmetrically disposed with respect to each other within the cavity defined by RF radome 4. In other embodiments, antenna elements 14*a*-14*d* may be disposed such that they are off-set relative to each other or on a different surface within the cavity defined by RF radome 4 relative to another antenna element. For example, a first antenna element 14*a* may be disposed on outer surface 12*a*, while a second antenna element 14*b* may be disposed on inner surface 4*a*. The arrangement and positioning of a respective one of the plurality of antenna elements 14*a*-14*n* can be designed based on a particular application and properties of the missile seeker 10.

It should be appreciated that any number of antenna elements 14*a*-14*n* may be disposed within missile seeker 10. For example, missile seeker 10 may include only one antenna element 14. In other embodiments, missile seeker 10 may include an array of X antenna elements 14*a*-14*n* where X is an integer greater than 2. In still other embodiments, each of the plurality of antenna elements 14*a*-14*n* may be an individual array of elements.

In an embodiment, missile seeker 10 may be designed with a variety of different types of antenna elements 14*a*-14*n*. For example, and referring briefly to FIG. 1C, in some embodiments, the plurality of antenna elements 14*a*-14*n* may include Vivaldi antenna 14*x*'. The Vivaldi antenna 14*x*' can be a co-planar broadband-antenna having a gap region 17*x*' formed between two generally symmetric sides, whereby the gap region 17*x*' operates as a radiating element. In the illustrative embodiment of FIG. 1B, the gap region 17*x*' is radiating in an upward direction. However, it should be appreciated that Vivaldi antenna 14*x*' and thus, gap region 17*x*', can be positioned in any orientation to receive and/or transmit signals in any direction based on a direction gap region 17*x*' is facing or radiating energy.

In some embodiments, antenna elements 14*a*-14*n* may be configured for forward transmission/reception. Antenna elements 14*a*-14*n* may include a variety of different antennas. For example, antenna elements 14*a*-14*n* may be provided as slot antennas, aperture antennas, dipole elements, monopole elements, notch antennas, Vivaldi antennas, half-Vivaldi antenna, or flare antennas. In an embodiment, the type antenna elements 14*a*-14*n* used may depend, at least in part, on a type of radiation pattern to be produced by missile seeker 10 and/or the dimensions of missile seeker 10. In some embodiments, the type antenna elements 14*a*-14*n* used may depend on an orientation of a respective one of the plurality of antenna elements 14*a*-14*n* with respect to the radome 4.

In one embodiment, missile seeker 10 and/or antenna elements 14*a*-14*n* are provided as the type described in co-pending U.S. patent application Ser. No. 14/971,223, filed on Dec. 16, 2015 and co-pending U.S. patent application Ser. No. 15/084,753, filed on Mar. 30, 2016, each of which are assigned to the assignee of the present application.

Figure 2A:
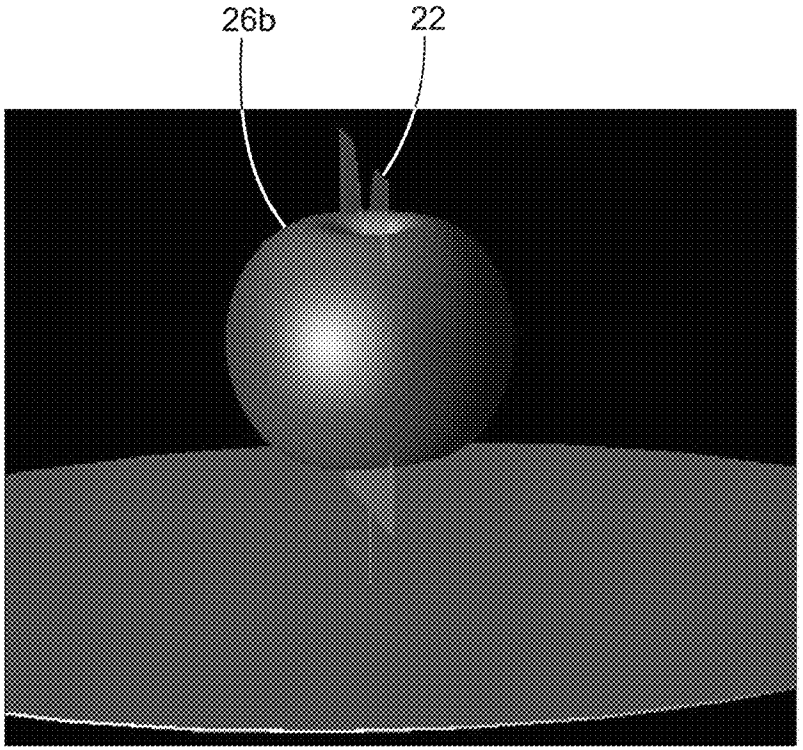
FIG. 2A is side view of a second radiation pattern of an antenna system.
Figure 2:
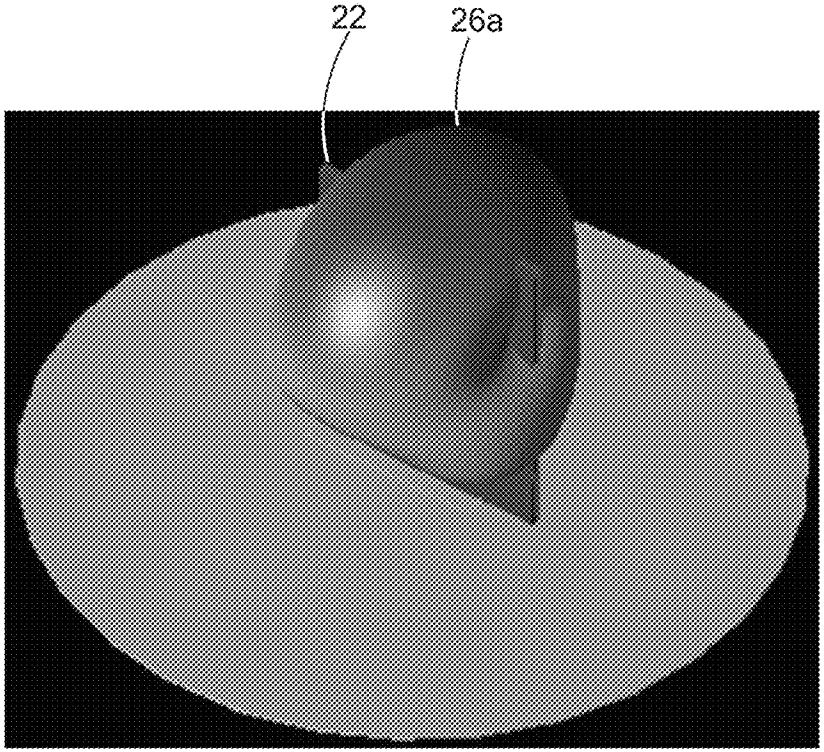
FIG. 2 is side view of a first radiation pattern of an antenna system.

Now referring to FIGS. 2-2A, an antenna system, such as missile seeker 10 of FIG. 1, may include a plurality switchable antenna elements 22 that can be individually controlled to generate a specific radiation pattern. For example, each of the antenna elements 22 (e.g., antenna elements 14*a*-14*n* of FIGS. 1-1C, antenna elements 24*a*-24*n* of FIGS. 2-2B.) can be modified to generate different radiation patterns to change an overall radiation pattern of the antenna system. For example, antenna element 22 can be switched from generating a first radiation pattern 26*a* (FIG. 2) to generating a second radiation pattern 26*b* (FIG. 2A) and vice versa. In the illustrative embodiment of FIG. 2, first radiation pattern 26*a* is shown. In some embodiments, the first radiation pattern 26*a* may be a forward radiation pattern. In the illustrative embodiment of FIG. 2A, a second radiation pattern 26*b* is shown. In some embodiments, the second radiation pattern 26*a* may be an omnidirectional radiation pattern. It should be appreciated that other radiation patterns may be generated using the systems and methods described herein. For example, in some embodiments, two or more or antenna elements 14*a*-14*n* may be combined in phase for reconfigurable beamforming. In one embodiment, antenna elements 14*a*-14*n* may include circular elements and be arranged in even rows along outer surface 12*a* of missile seeker 10 to create reconfigurable arrays.

In some embodiments, a radiation pattern of an antenna system may be based, at least in part on, an orientation of antenna elements (e.g., first orientation, second orientation) and/or the type of antenna elements (e.g., Vivaldi, half-Vivaldi, etc.). For example, in some embodiments, an antenna system, may include antenna elements of the same type. In other embodiments, an antenna system, may include antenna elements of two or more different types. In some embodiments, an antenna system may include one or more different types of antenna elements disposed in one or more different types of orientations.

Figure 3A:
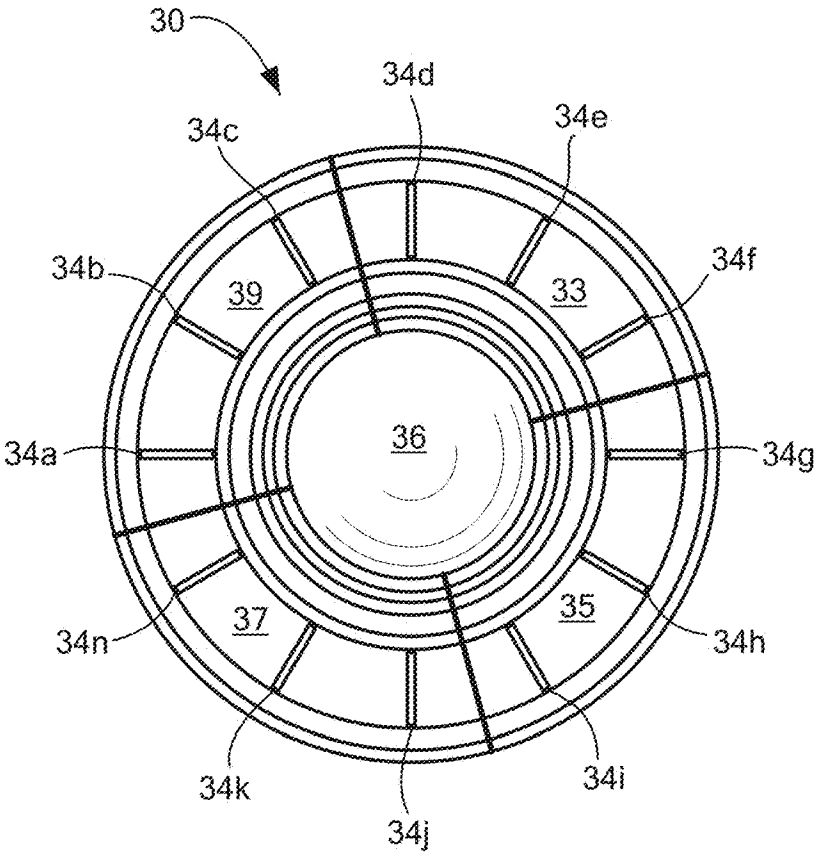
FIG. 3A is a top view of a plurality of antenna elements disposed around a circumference of a radome in a second orientation.
Figure 3:
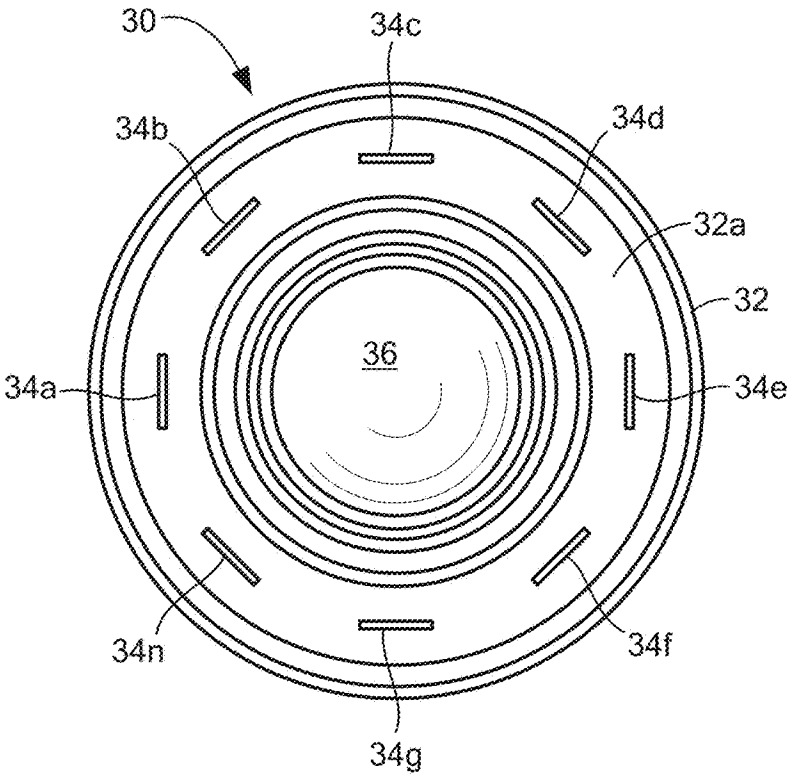
FIG. 3 is a top view of a plurality of antenna elements disposed around a circumference of a radome in a first orientation.
Figure 3B:
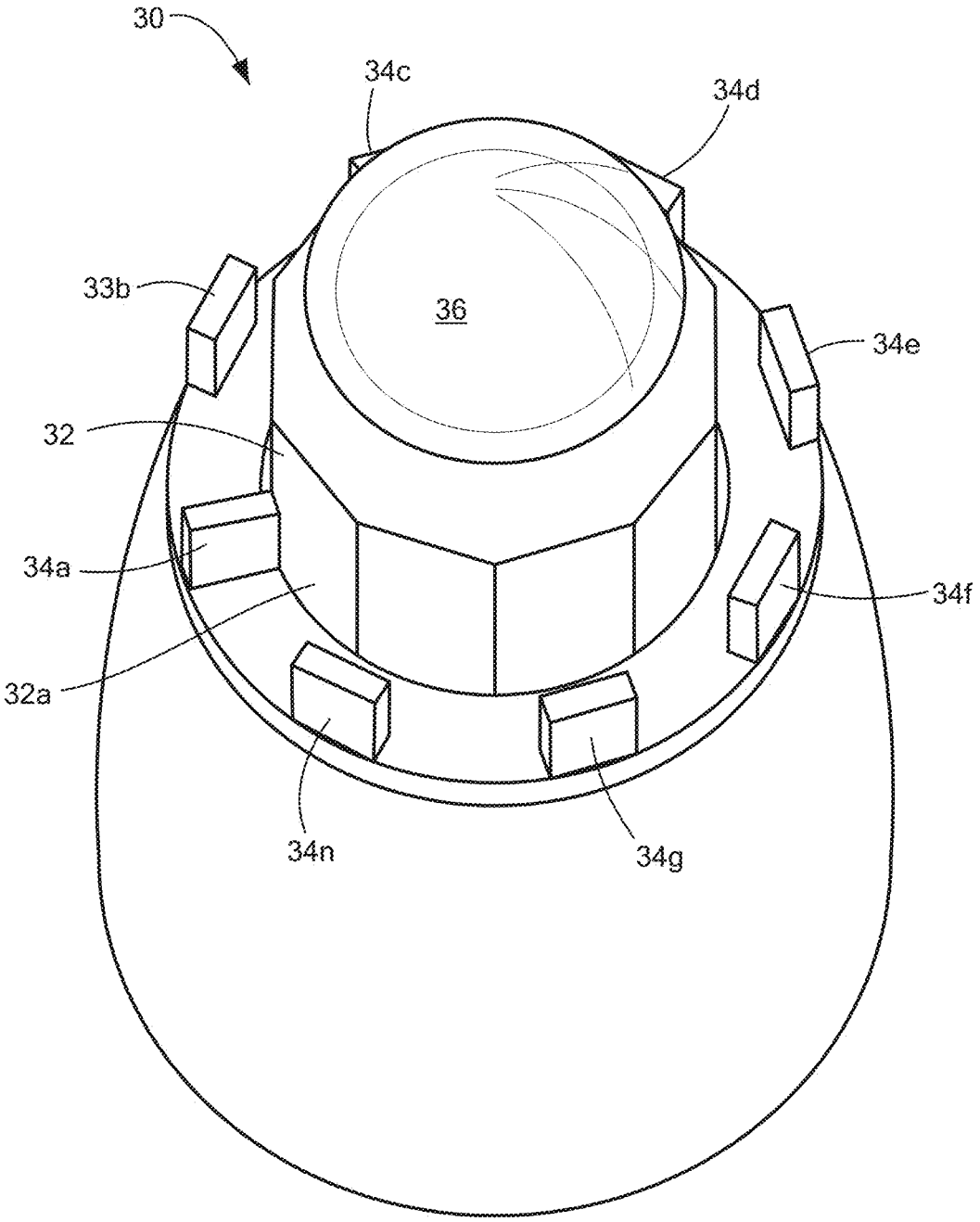
FIG. 3B is a top view of a plurality of antenna elements disposed around a circumference of a radome in a third orientation.

Now referring to FIGS. 3-3B, an antenna system 30 includes a sensor 36 disposed on a top surface of a pedestal 32. A plurality of antenna elements 34*a*-34*n* are disposed along an outer surface 32*a* of pedestal 32. The plurality of antenna elements 34*a*-34*n* are symmetrically disposed in a circumferential direction around the outer surface 32*a*. In some embodiments, the outer surface 32*a* may include a ground plane 32*a* that is disposed under the plurality of antenna elements 34*a*-34*n*.

In an embodiment, the plurality of antenna elements 34*a*-34*n* may be positioned in the circumferential direction around the outer surface 32*a* in a variety of different orientations to generate a desired radiation pattern. In an embodiment, orientation may refer to a position of a respective antenna elements with respect to the outer surface 32*a* of the pedestal 32 (or a cavity defined by a radome).

In some embodiments, one or more of the plurality of antenna elements 34*a*-34*n* can be disposed having a same or a different orientation with respect to an another antenna element. For example, and as illustrated in FIG. 3, each of the plurality of antenna elements 34*a*-34*n* may have the same orientation. In some embodiments, in a first orientation, each of the plurality of antenna elements 34*a*-34*n* may be posited such that they are substantially parallel to the outer surface 32*a*. In other embodiments, and as illustrated in FIG. 3A, each of the plurality of antenna elements 34*a*-34*n* may be disposed in a second orientation (different from the first orientation). In an embodiment, in the second orientation, each of the plurality of antenna elements 34*a*-34*n* may be positioned such that they are substantially perpendicular to the outer surface 32*a*.

In some embodiments, each of the plurality of antenna elements 34*a*-34*n* may be switched to a different orientation together (e.g., simultaneously). In other embodiments, the plurality of antenna elements 34*a*-34*n* may be switched one at a time or some predetermined order. It should be appreciated that switching as used herein may refer to changing an orientation of one or more of antenna elements 34*a*-34*n* and switching may refer to switching between different antenna elements 34*a*-34*n* (providing a feed signal to different antenna elements) to change and/or generate a different radiation pattern.

In some embodiments, the antenna elements 34*a*-34*n* may be arranged into multiple sectors 33, 35, 37, 39 (here 4). One or more of sectors 33, 35, 37, 39 may have a different operational frequency and/or wavelength from another different one of sectors 33, 35, 37, 39. Thus, the antenna elements 34*a*-34*n* in the respective sectors 33, 35, 37, 39 may have different properties. The different sectors allow for frequency diversity schemes whereby two or more antennas 34*a*-34*n* may be selected in one or more of sectors 33, 35, 37, 39 based at least in part on a spatial separation and the corresponding wavelengths.

In some embodiments, one or more of the plurality of antenna elements 34*a*-34*n* may be positioned in a different orientation as compared to another antenna element. For example, and as illustrated in FIG. 3B, a first antenna element 34*a* may be positioned having a first orientation and each of the remaining antenna elements 34*a*-34*n* may be positioned having a second orientation. Each orientation may provide different measurements and various flexibilities to provide polarization diversity for antenna system 30. In some embodiments, two or more of the plurality of antenna elements 34*a*-34*n* may be positioned in a different orientation as compared to another antenna element. The orientation of each of the respective antenna elements 34*a*-34*n* in antenna system 30 may be selected, based at least in part on, a desired radiation pattern of antenna system 30, a position of one or more of antenna elements 34*a*-34*n*, operational frequencies (frequency diversity), polarization (polarization diversity), sectorization of antenna elements 34*a*-34*n* and/or beamforming requirements.

It should be appreciated that FIGS. 3-3B illustrate example embodiments of orientations of the antenna elements, however other orientations are possible using the systems and methods described herein. The orientation of one or more of the plurality of antenna elements 34*a*-34*n* may depend, at least in part, on a desired radiation pattern of antenna system 30, the dimensions of the antenna system 30 and/or dimensions of the surface the plurality of antenna elements 34*a*-34*n* are coupled to or otherwise formed on or within.

Figure 4:
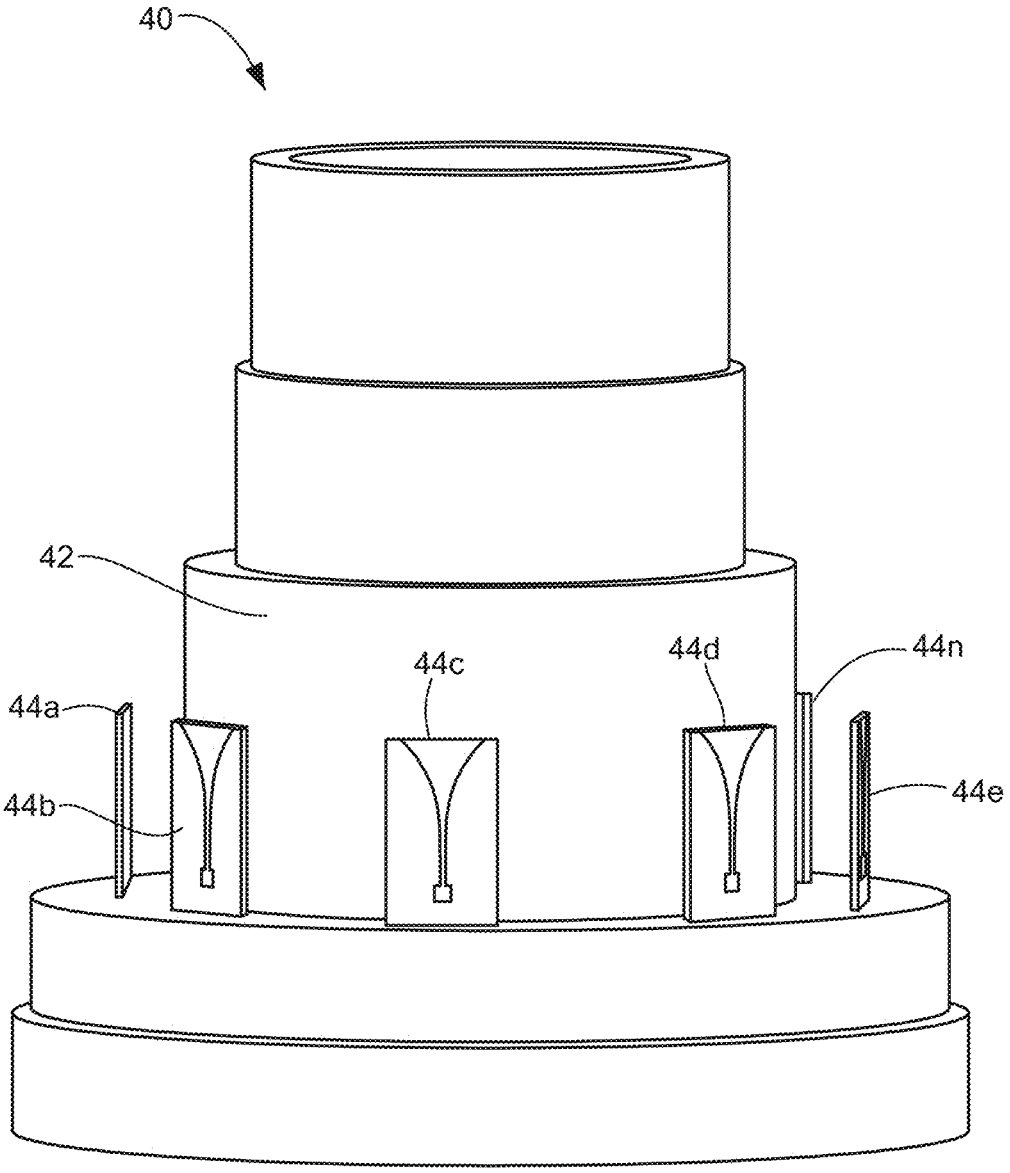
FIG. 4 is an isometric view of an antenna system with a plurality of antenna elements in a first arrangement.
Figure 4A:
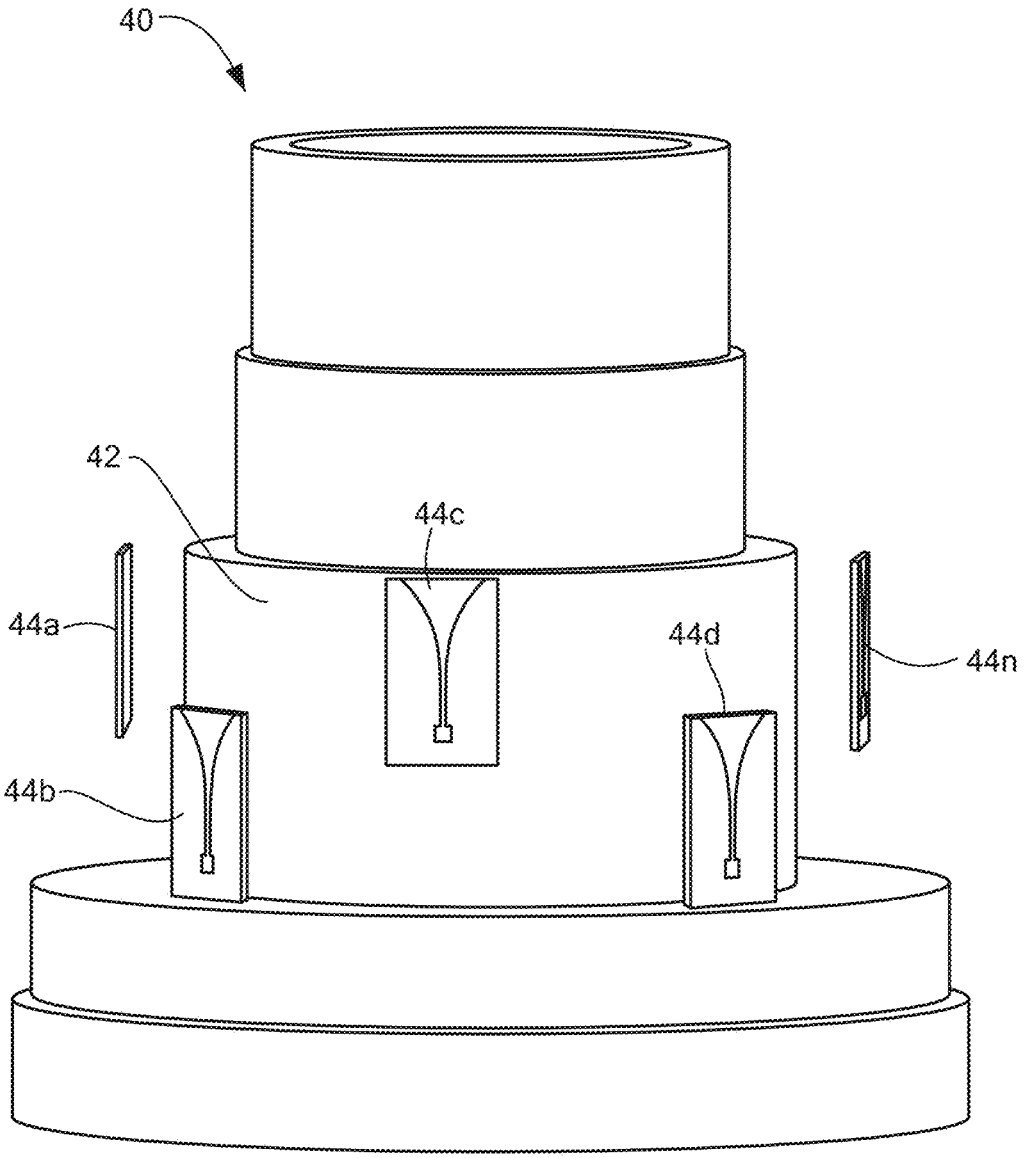
FIG. 4A is an isometric view of an antenna system with a plurality of antenna elements in a second arrangement.

Now referring to FIGS. 4-4A, an antenna system 40 includes a plurality of antenna elements 44*a*-44*n* disposed along an outer surface 42*a* of pedestal 42. In an embodiment, the plurality of antenna elements 44*a*-44*n* can be symmetrically disposed in a circumferential direction around the outer surface 42*a*.

In an embodiment, the plurality of antenna elements may be positioned at various heights (or levels) of outer surface 42*a* (e.g., lower portion, middle portion, upper portion). For example, in the illustrative embodiment of FIG. 4, each of the antenna elements 44*a*-44*n* can be positioned at a bottom portion of pedestal 42 relative to a peak of antenna system 40.

In some embodiments, each of the antenna elements 44*a*-44*n* are positioned at the same height or level along outer surface 42*a*. In other embodiments, one or more antenna elements 44*a*-44*n* may be positioned at different heights or levels along outer surface 42*a* for space diversity between one or more of antenna elements 44*a*-44*n*. For example, and as illustrated in FIG. 4A, a first, third and fifth antenna element 44*a*, 44*c*, 44*n* are positioned at a different (here higher) height along outer surface 42*a* than a second and fourth antenna elements 44*b*, 44*d*. In an embodiment, a height of a respective antenna element 44 may be selected based, at least in part, on a desired radiation pattern of antenna system 40 and/or dimensions of the antenna system 40.

In some embodiments, one or more antenna elements 44*a*-44*n* along a first half outer surface 42*a* may be positioned at a first height or level and a second group of antenna elements 44*a*-44*n* along a second half outer surface 42*a* may be positioned at a second height or level along outer surface 42*a*. The pairing and/or pattern of how one or more antenna elements are positioned along outer surface 42*a* may vary according to a particular application of antenna system 40.

In some embodiments, a height of a respective antenna element 44 may be selected based, at least in part, on the type of antenna element (e.g., Vivaldi, half-Vivaldi, etc.) For example, in some embodiments, antenna elements 44*a*-44*n* of a first type may be positioned at a first height and antenna elements 44*a*-44*n* of a second type may be posited at a second (different) height along outer surface 42*a*.

While the concepts, systems and techniques sought to be protected have been particularly shown and described with references to illustrated embodiments thereof, it will be understood by those skilled in the art that various changes in form and details may be made therein without departing from the spirit and scope of the concepts as defined by the appended claims.

Elements of different embodiments described herein may be combined to form other embodiments not specifically set forth above. Other embodiments not specifically described herein are also within the scope of the following claims.

What is claimed:

1. A radome comprising:

a housing, which defines a radome cavity, said housing, having a first surface and a second surface; and a plurality of switchable radio frequency (RF) antenna elements disposed within the radome cavity, wherein each of the plurality of switchable RF antenna elements is configured to be switchable between a forward radiation pattern to an omnidirectional radiation pattern.

2. The radome of claim 1, further comprising a ground plane disposed within a bottom portion of the radome cavity.

3. The radome of claim 2, wherein each of the plurality of switchable RF antenna elements are disposed along a circumferential direction around the radome cavity such that each of the plurality of switchable RF antenna elements are positioned between a top portion of the radome cavity and the ground plane.

4. The radome of claim 3, wherein the one or more of the plurality of switchable RF antenna elements are disposed at a different level relative to the ground plane and along the circumferential direction around an IR sensor pedestal with respect to another switchable RE antenna element.

5. The radome of claim 1, wherein the one or more of the plurality of switchable RE antenna elements have a different orientation with respect to another switchable RF antenna element.

6. The radome of claim 1, wherein each of the plurality of switchable RF antenna elements is recessed within an outer surface of the housing.

7. An antenna comprising:

a radio frequency (RF) radome region; and a plurality of switchable radio frequency (RF) antenna elements disposed within the RF radome region, wherein each of the plurality of switchable RF antenna elements is configured to be switchable between a forward radiation pattern to an omnidirectional radiation pattern to change an array radiation pattern of the antenna.

8. The antenna of claim 7, wherein the one or more of the plurality of switchable RF antenna elements have a different orientation with respect to another switchable RF antenna element.

9. The antenna of claim 7, wherein the one or more of the plurality of switchable RF antenna elements are disposed at a different level along a circumferential direction around an inner surface of the RF radome region with respect to another switchable RE antenna element.

* * * * *